US005285738A

United States Patent [19]

Cullen

[11] Patent Number: 5,285,738

[45] Date of Patent: * Feb. 15, 1994

[54] PELLET BURNING HEATING DEVICE

[75] Inventor: Leslie D. Cullen, Boise, Id.

[73] Assignee: Mountain Home Development Company, Eagle, Id.

[ * ] Notice: The portion of the term of this patent subsequent to Jul. 28, 2009 has been disclaimed.

[21] Appl. No.: 918,550

[22] Filed: Jul. 22, 1992

Related U.S. Application Data

[63] Continuation-in-part of Ser. No. 778,334, Oct. 17, 1991, Pat. No. 5,133,266.

[51] Int. Cl.[5] ..... F23B 7/00

[52] U.S. Cl. ..... 110/233; 110/110; 110/297; 126/58; 126/200

[58] Field of Search ..... 110/110, 233, 108, 102, 110/314, 297; 126/58, 65, 66, 200

[56] References Cited

U.S. PATENT DOCUMENTS

| | | | |
|---|---|---|---|
| 236,961 | 1/1881 | Shepard . | |
| 425,320 | 4/1890 | Harkins . | |
| 862,142 | 8/1907 | Dimpsey . | |
| 1,952,227 | 11/1930 | Adams | 110/7 |
| 2,499,864 | 3/1950 | Heller | 158/91 |
| 4,017,254 | 4/1977 | Jones | 432/72 |
| 4,414,904 | 11/1983 | Foster | 110/102 |
| 4,565,184 | 1/1986 | Collins et al. | 110/110 |
| 4,593,629 | 6/1986 | Pedersen et al. | 110/172 |
| 4,619,209 | 10/1986 | Traeger et al. | 110/110 |
| 4,669,396 | 6/1987 | Resh | 110/233 |
| 4,779,554 | 10/1988 | Stevens | 110/110 |
| 4,941,414 | 7/1990 | Carlson | 110/108 |
| 5,001,993 | 3/1991 | Gramlow | 110/233 |
| 5,070,798 | 12/1991 | Jurgens | 110/110 |
| 5,123,360 | 6/1992 | Burke et al. | 110/233 |
| 5,137,012 | 8/1992 | Crossman, Jr. et al. | 110/110 X |

OTHER PUBLICATIONS

Pellet Master brochure (2 pages), date unknown.
Welenco ® brochure (3 pages), date unknown.
Augermatic TM brochure (2 page), date unknown.
Scott Stoves, Inc. brochure (2 pages), date unknown.
Venturi by Pelletier, Inc. brochure (2 pages), date unknown.

*Primary Examiner*—Edward G. Favors
*Attorney, Agent, or Firm*—Christensen, O'Connor, Johnson & Kindness

[57] ABSTRACT

A pellet burning heating device (20) designed to operate at a combustion efficiency of about 90–98% (based on the oxygen-derived combustion efficiency formula), and to emit exhaust gases having a carbon monoxide concentration, by volume, of about 0.04% or less, which device does not incorporate a fan system for introducing combustion air into, or extracting exhaust gases from, the stove. High combustion efficiency and clean burning are accomplished by providing a plurality of apertures (130, 132) in the burn pot (120) of the device having a predetermined size, number, and placement. The heating device (20) also includes an aperture (200) which provides a wash of relatively cool air to the inside surface of the window in order to reduce carbon deposits. A shaker (160) located in the burn pot (120) provides a heat sink which helps to increase the efficiency of the heating device. In addition, a drop chute (214) located in between the feed assembly (60) and the combustion flame (154) prevents the possibility of any back burn of the combustion flame into the pellet hopper (40).

20 Claims, 5 Drawing Sheets

PELLET BURNING HEATING DEVICE

CROSS-REFERENCE TO RELATED APPLICATION

This application is a continuation-in-part of U.S. patent application Ser. No. 07/778,334, filed Oct. 17, 1991, U.S. Pat. No. 5,133,266 and entitled Pellet Burning Heating Device.

FIELD OF THE INVENTION

The present invention relates to pellet burning heating devices, e.g., stoves, and more particularly to means for controlling the introduction of combustion air to pellet burning heating devices so as to minimize the quantity of hazardous substances in the exhaust gases of the device and to means for reducing the chance of back burns.

BACKGROUND OF THE INVENTION

Pellet burning stoves of the type disclosed in U.S. Pat. Nos. 4,619,209, 4,669,396, and 4,779,554 have become very popular in recent years due to their low emission levels, high combustion efficiency, and ease of operation. Such stoves typically comprise a combustion chamber, a burn pot coupled with the combustion chamber for supporting pellets during the combustion process, a hopper for storing pellets, and an auger assembly for transporting pellets from the hopper to the burn pot. The burn pot of pellet burning stoves of the type disclosed in the patents identified above typically comprises a plurality of holes extending through the sidewall of the burn pot through which combustion air is introduced to the pot.

In an attempt to improve the combustion efficiency and reduce the quantity of harmful gases emitted from pellet stoves, fan systems have been added to such stoves to force combustion air into the burn pot or to draw exhaust gases out of the combustion chamber. Indeed, it is believed that all pellet stoves currently marketed in the United States which are designed to emit exhaust gases having a carbon monoxide concentration, by volume, of less than 0.04% utilize a fan system for forcing air into, or drawing gases out of, the stove. Because the speed of the fan must be automatically varied based on the desired heat output, the actual burn rate, and other factors to ensure clean burning and high combustion efficiency, a microprocessor-controlled fan adjustment system is required. For instance, the clean burning commercial embodiment of the pellet stove disclosed in U.S. Pat. No. 4,779,544, i.e., the embodiment designed to emit exhaust gases having CO levels of less than 0.04%, uses an exhaust fan to extract exhaust gases from the stove. Although the '544 patent is silent regarding the manner in which exhaust gases are withdrawn from the stove, the construction of the stove is such that an exhaust fan is believed to be required to achieve clean burning, as evidenced by the use of an exhaust fan on the commercial embodiment of the stove of the '544 patent (the Welenco Pellet Heater manufactured by Welenco Mfg. Inc., Lewiston, Id.).

The use of one or more fans and an associated control system typically adds about $200 to $300 to the retail cost of such a stove. Additionally, although the control system can be shielded to some extent from the high temperatures adjacent the stove, in practice the service life of the printed circuit board and other components of the fan control system is often reduced to an unacceptably short period as a consequence of the high temperature environment in which the control system must operate.

To ensure a pellet stove burns as cleanly as possible, the quantity of combustion air introduced into the burn pot through the apertures in the sidewall thereof must be carefully controlled. In pellet stoves designed to emit exhaust gases having CO concentrations of less than 0.04%, delivery of the proper quantity of combustion air is typically achieved by appropriate operation of the fan system for introducing combustion air into or withdrawing exhaust gases from the stove. Because delivery of a proper quantity of combustion air is virtually ensured if appropriately sized fans are used and if the microprocessor of the fan control system is correctly programmed, the size, number, and placement of the apertures in the sidewall of the burn pot through which combustion air is introduced are not critical to the clean burning operation of the stove. As a consequence, it is believed that little research has been conducted regarding the size, number, and placement of the combustion air intake apertures in the burn pots of pellet burning stoves required to achieve optimal combustion efficiency and minimal emissions of harmful exhaust gases.

Recently, carbon monoxide concentration in stove exhaust gases has become regarded by many as the preferred indicator of overall cleanliness of stove exhaust, with CO levels below 0.04% being achieved only by the cleaner-burning pellet stoves. A carbon monoxide concentration of 0.04% correlates closely with a particulate count of about 7 grams per hour, the current EPA standard for wood stoves not equipped with a catalytic converter. Particulate count is the older, and many feel the less accurate, technique for determining combustion efficiency of a stove.

One of the problems associated with some pellet burning stoves is "back burn." Back burn occurs when pellets are fed into the burn pot faster than they are consumed by the fire. This causes an accumulation of unburned pellets in the burn pot and subsequently an overflow of the pot. If not properly designed, the overflow causes the pellets to back up in the feed chute, thus allowing the fire to follow the pellets up the feed chute and possibly into the pellet storage area.

SUMMARY OF THE INVENTION

The present invention is a pellet burning heating device which is designed to emit exhaust gases having a carbon monoxide concentration, by volume, of less than 0.04%. One embodiment of the present invention does not use a fan system for introducing combustion air into, or extracting exhaust gases from, the device.

The present invention is a pellet burning heating device designed to be coupled with a chimney having a predetermined natural draft, the device comprising a housing having a combustion chamber, a burn pot coupled with the combustion chamber and having a plurality of selectively sized and positioned apertures extending through the bottom and sidewall thereof, and a feed assembly for feeding pellets into the burn pot. The housing has a first aperture through which exhaust gases may escape from the combustion chamber. The burn pot is attached to the housing so that its hollow interior is in communication with the combustion chamber via a second aperture in the housing.

According to other aspects of the invention, the feed assembly is designed to dispense pellets into the interior of the burn pot at a selected rate such that a predetermined quantity of pellets is maintained in the interior, i.e., so that the pellet level remains substantially constant. The size, number, and placement of the apertures in the bottom and sidewall of the burn pot are selected; i.e., the burn pot is "tuned," to ensure that the quantity and mixture of primary and secondary combustion air which flows through the apertures into the burn pot is such that clean-burning operation is maintained without the need for a fan system for introducing combustion air into or extracting exhaust gases from the stove.

According to still other aspects of the invention, the heating device includes air supply means for providing airflow to a portion of the combustion flame above the burn pot. The air supply is toroidal shaped and includes a plurality of apertures on its inner surface that provide airflow to the combustion flame. The heating device also includes a window mounted in the combustion chamber to permit viewing of the combustion chamber. A wash of relatively cool air from the exterior of the heating device flows over the inner surface of the window to reduce the tendency of carbon deposits to build up on the inner surface. The heating device also includes shaker means located in the burn pot for agitating unburnt pellets and ash located in the bottom of the burn pot. The shaker means also provides a heat sink which increases combustion efficiency.

In order to prevent the possibility of back burn, the heating device includes a drop chute. The drop chute is positioned between the pellet feed assembly and the interior of said burn pot. Pellets exit the feed assembly and drop downwardly through the drop chute and into the burn pot. In case of pellet overflow, pellets build up in the drop chute thus increasing the force of the pellets at the drop chute outlet. As the combustion flame burns upwardly toward the drop chute, the force of the buildup of pellets flushes the drop chute and ensures that the combustion flame does not burn upwardly into the pellet hopper.

DETAILED DESCRIPTION OF THE PREFERRED EMBODIMENT

Figure 1:
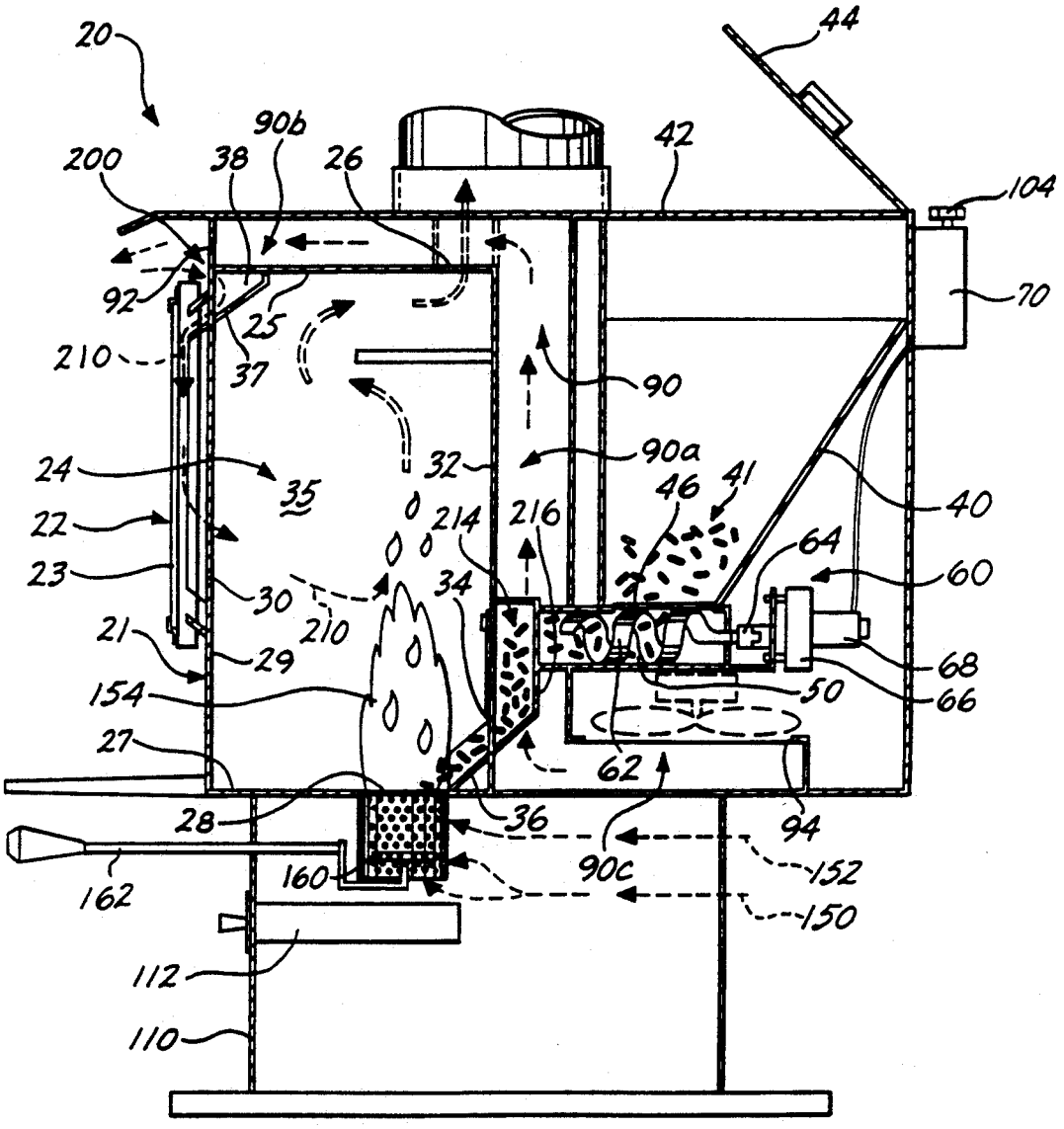
FIG. 1 is a cross section, side elevational view of a heating device of the present invention.
Figure 2:
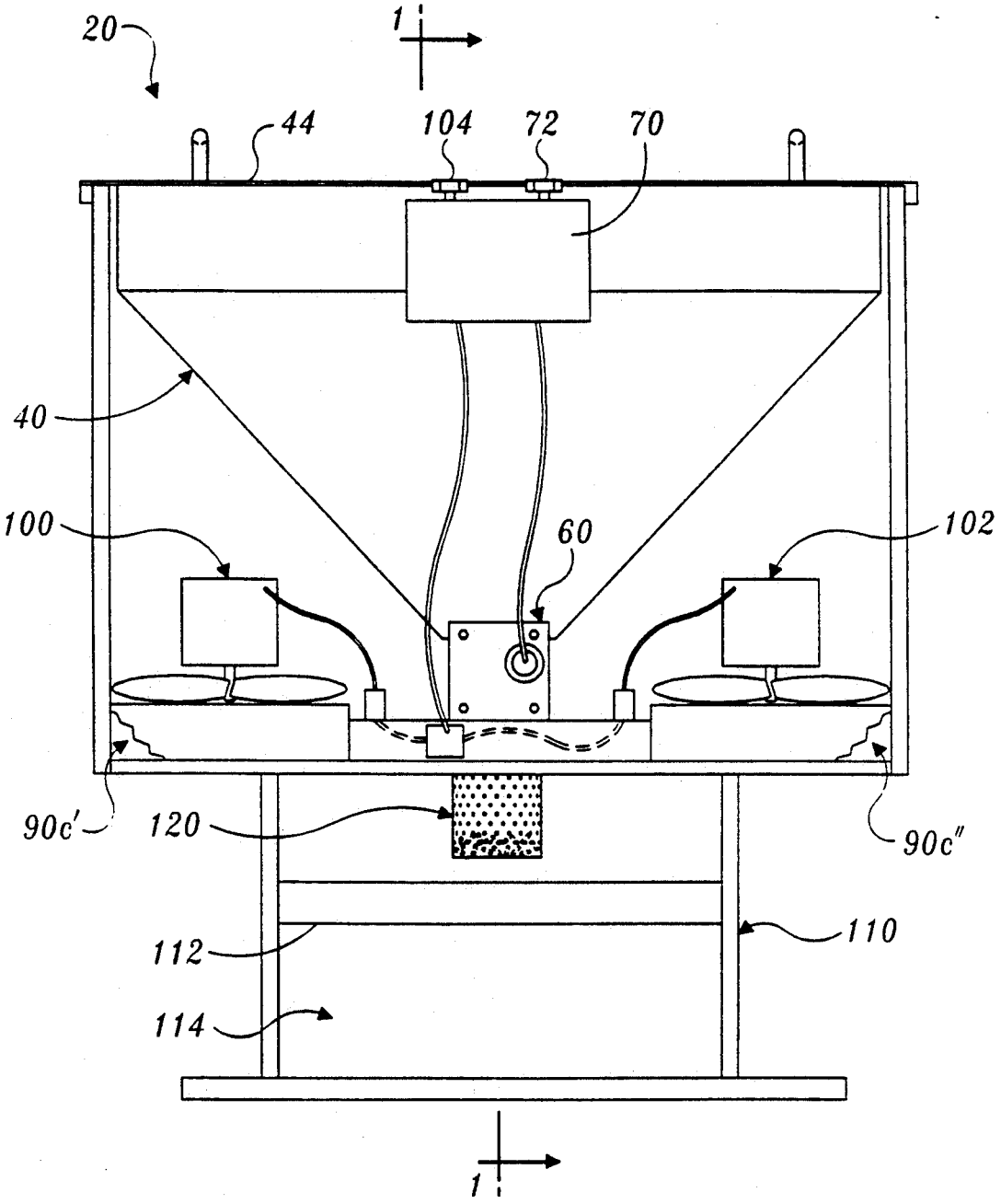
FIG. 2 is a rear elevational view of the device illustrated in FIG. 1.

Referring to FIGS. 1 and 2, the present invention is a pellet burning heating device 20 which is designed so that combustion air is introduced solely by natural convection and exhaust gases are withdrawn solely by the natural draft of the chimney with which the device is coupled. Furthermore, as a consequence of the design of the heating device 20, the exhaust gases emitted from the device have a carbon monoxide ("CO") concentration, by volume, of 0.04% or less.

Heating device 20 is illustrated and described herein as a pellet burning stove. However, as those of ordinary skill in the art will appreciate, the design and principles of operation of device 20 may be incorporated in a furnace, boiler, hot water heater, and other heating devices.

Device 20 comprises a housing 21 having a front door 22 with a window 23 positioned therein. Housing 21 includes combustion chamber 24 in which a significant portion of the combustion of the wood gases driven off by the initial burning of the pellets occurs, as discussed in more detail below. Housing 21 comprises a ceiling 25 having a first aperture 26 through which exhaust gases pass out of combustion chamber 24, and a floor 27 having a second or bottom aperture 28 through which combustion air and wood gases are introduced into the combustion chamber, also as described in more detail below. Housing 21 also comprises a front wall 29 having a door opening 30 therein. Opening 30 is sized and positioned so that combustion chamber 24 may be viewed through window 23 in door 22 and opening 30. Housing 21 also includes a rear wall 32 having a feed opening 34 near the bottom end thereof, and opposing sidewalls, one of which is identified at 35 in FIG. 1.

Housing 21 also includes a plate 37 attached to sidewalls 35 and ceiling 25 adjacent the junction of the ceiling and the front wall 29 so as to extend horizontally across the entire width of combustion chamber 24. Plate 37 is sized and positioned so as to enclose and define, together with adjacent portions of front wall 29 and ceiling 25, an air passageway 38 extending across the entire width of combustion chamber 24 and terminating at the sidewalls of stove 20. Plate 37 extends through opening 30 in front wall 29 and terminates near, i.e., about 0.5 inch inwardly of, the inner surface of window 23. A fourth aperture or opening 200 is located in the front wall 29 of the housing such that it provides an opening from outside the stove 20 into the air passageway 38. The opening could be a slot extending approximately across the width of the window 23 or a series of holes. The opening 200 allows air as shown by arrows 210 to enter the stove 20 and flow into the air passageway 38.

Plate 37, the passageway 38 enclosed thereby, and an opening 200 are provided to supply a wash of cool air to window 23 in door 22 and to provide additional air for improved combustion as will be described in more detail hereinafter. During operation of device 20, relatively cool air passes through the opening 200 into passageway 38, travels along the passageway and spills out along the outermost part of plate 37 onto the inner surface of window 23, as shown by arrows 210. This cool air wash prevents carbon deposits from building up on the inner surface of window 23, thereby permitting the viewing of the fire within combustion chamber 24. The opening 200 should be sized to allow sufficient quantities of air to enter the combustion chamber 24 so as to provide secondary air to improve combustion as described later.

Device 20 also includes a pellet hopper 40 for storing a predetermined quantity of the pellets 41 to be burned in the device 20. In one embodiment, hopper 40 is sized to store about 50 pounds of conventional pellets, i.e., pellets of the type identified by the label "APFI" (American Pellet Fuel Institute). Hopper 40 comprises a top opening 42 through which pellets may be added to the hopper. A door 44 is provided for closing off opening 42. Hopper 40 additionally comprises a bottom opening 46 through which pellets contained in hopper 40 will be drawn, under the pull of gravity, into feed chamber 50. Feed chamber 50 extends between the bottom opening 46 in hopper 40 and a drop chute 214, whereby a continuous passageway is provided between bottom opening 46 and drop chute 214. Drop chute 214 is formed by the rear wall 32 of the combustion chamber and a rear wall 216 of the drop chute. The rear wall 216 of the drop chute is attached to the opening at the end of the feed chamber 50 and extends downwardly past the top of the feed opening 34 and is connected to and terminates at a ramp 36. Ramp 36 slants downwardly from the bottom of the rear wall 216 and extends through the feed opening 34 to the aperture 28, in order to transport pellets dispensed from the feed chamber 50 to aperture 28 as discussed more fully below.

Device 20 additionally comprises a feed mechanism 60 for urging pellets which have traveled from hopper 40 into feed chamber 50 out of the end of the latter, into drop chute 214, down ramp 36, through combustion air aperture 28, and into burn pot 120, the latter being described in more detail hereinafter. The use of drop chute 214 allows the pellets exiting the feed chamber 50 to drop a distance before contacting and traveling down ramp 36 to aperture 28. This configuration prevents back burn as described in more detail later. Feed mechanism 60 comprises an auger 62 positioned in feed chamber 50, a universal joint 64 attached to the rear end of the auger, a gear reduction box 66 coupled to the rear end of universal joint 64, and a motor 68 coupled to gear reduction box 66. Motor 68 is coupled with a speed control device 70 which comprises a speed control mechanism (not shown), such as a potentiometer, which is operated by appropriate manipulation of a knob 72 (FIG. 2) coupled therewith. The various components of feed mechanism 60 are preferably designed so that the weight of pellets 41 dispensed by the feed mechanism through feed opening 34 ranges from 0.75 pounds per hour to 6 pounds per hour, depending upon the ratational setting of knob 72. Slower or faster feed rates may be achieved by appropriate design of feed mechanism 60 and speed control device 70.

The pellet burning heating device also includes combustion air intake means for coupling the combustion chamber with the atmosphere surrounding the housing to permit combustion air to flow into the combustion chamber. Air is supplied to the combustion chamber in order to permit pellets positioned in the interior of the burn pot to burn in a manner that generates exhaust gasses having a carbon monoxide concentration of less than 0.04%. The combustion air intake means includes a third aperture in the burn pot that permits combustion airflow into the burn pot and a fourth aperture in the housing that permits airflow into the combustion chamber.

As discussed above, back burn is a problem with some pellet burning stoves. Back burn occurs when the pellets overflow the burn pot and back up on the ramp 36 and into the feed mechanism. In some prior designs, the fire could burn up through the pellets into the hopper 40. The drop chute 214 of the present invention prevents the possibility of back burn. When pellets overflow the burn pot, they back up on the ramp 36 and into the drop chute 214. As pellets build up in the drop chute, they increase the force on the pellets exiting the drop chute at feed opening 34. When fire begins to burn the over-flowing pellets, the force of the pellets backed up in the drop chute causes a flush of pellets down the drop chute 214 out feed opening 34 and into the combustion chamber. This flushing action prevents the fire from ever reaching the hopper 40.

Device 20 further includes a convection system for causing room temperature air to enter and move within device 20 so as to be heated by the high temperature gases present in combustion chamber 24 and then be exhausted into the room in which device 20 is positioned. This convection system comprises a convection chamber 90 (FIG. 1) comprising a central portion **90*a* positioned between housing 21 and hopper 40 so as to confront the back surface of rear wall 32 of housing 21 and to be spaced slightly from the front wall of hopper 40. Convection chamber 90 also comprises an upper portion 90*b* which is coupled with the upper end of central portion 90*a*, and confronts and extends along the upper surface of ceiling 25 of housing 21. Upper portion 90*b* terminates in an opening 92 through which heated air present in upper portion 90*b* may be exhausted from the latter. Convection chamber 90 also comprises a bottom portion 90*c* coupled with the bottom end of central portion 90*a* and positioned so as to extend rearwardly therefrom. As best illustrated in FIG. 2, lower portion 90*c* is bifurcated with portion 90*c* ' being positioned to the left of feed assembly 60, and right portion 90*c*'' being positioned to the right of feed mechanism 60. Right portion 90*c*'' comprises an opening 94 (FIG. 1) through which room temperature air may be introduced into this portion of the convection chamber 90. A similar opening (not shown) is provided in left portion 90*c*'**.

The convention system of device 20 further comprises fans 100 and 102 which are positioned above left portion **90*c*' and right portion 90*c*'', respectively. Fans 100 and 102 are provided for forcing room temperature air through openings 94 in left and right portions 90*c*' and 90*c*'' so as to cause such air to move through lower portion 90*c*, up through central portion 90*a*, through upper portion 90*b*, and out of the upper portion through opening 92. As the room temperature air introduced into lower portion 90*c* by fans 100 and 102 travels upwardly through central portion 90*a*, heat present in combustion chamber 24 is conducted through rear wall 32 of housing 21 so as to heat the air as it passes through the central portion. Additional heating of this air occurs as it travels through an upper portion 90*b* prior to its discharge through opening 92**.

Fans 100 and 102 are also coupled with speed control device 70. The latter comprises a second speed control mechanism (not shown) for adjusting the operating speed of fans 100 and 102. The operation of this second speed control mechanism is controlled by appropriate manipulation of a knob 104 which is mounted adjacent knob 72 on the upper surface of speed control device 70.

The convection system of device 20 described above constitutes an effective mechanism for transferring heat generated as a consequence of the pellet combustion process into the room in which the stove is located. However, it is to be appreciated that the chamber 90 and fans 100 and 102 are not required. Indeed, highly effective heat transfer from device 20 into the room in which the stove is located occurs by matiral convection and conduction alone.

The convection system of device 20 does not urge combustion air into combustion chamber 24 or extract exhaust gases from the combustion chamber. As discussed in more detail below, such introduction and extraction is accomplished solely by natural convection forces.

The components of device 20 described above, i.e., housing 21, hopper 40, feed chamber 50, feed mechanism 60, and convection chamber 90, are all supported on a pedestal 110. The latter is designed to support these components a selected distance, e.g., about 18 inches, above the surface on which device 20 is positioned. Pedestal 110 includes an ash drawer 112 positioned beneath burn pot 120, and a rear opening 114 (FIG. 2) through which combustion air traveling to burn pot 120 may pass.

Referring now to FIGS. 1–4, device 20 further comprises a burn pot 120 for supporting pellets during the combustion thereof. Burn pot 120 comprises a bottom wall 122 (FIG. 4) and a sidewall 124 (FIG. 3) which is attached to the bottom wall. Together, bottom wall 122 and sidewall 124 enclose and define the interior 126 of the burn pot. The upper end of burn pot 120 is open, and an annular flange 128 is attached to the uppermost portion of sidewall 124 so as to extend radially outwardly therefrom. Flange 128 is provided for securing burn pot 120 to floor 27 such that an airtight seal is achieved between the upper end of the burn pot and floor 27 and so that interior 126 of the burn pot is aligned with combustion air aperture 28 in floor 27. As a consequence of this attachment of burn pot 120 to floor 27, interior 126 of the burn pot is in direct communication with combustion chamber 24 of housing 21 via combustion air aperture 28. The size and configuration of air aperture 28 is selected so as to be similar, if not identical, to the size and cross-sectional configuration of interior 126 of burn pot 120.

Figure 5:
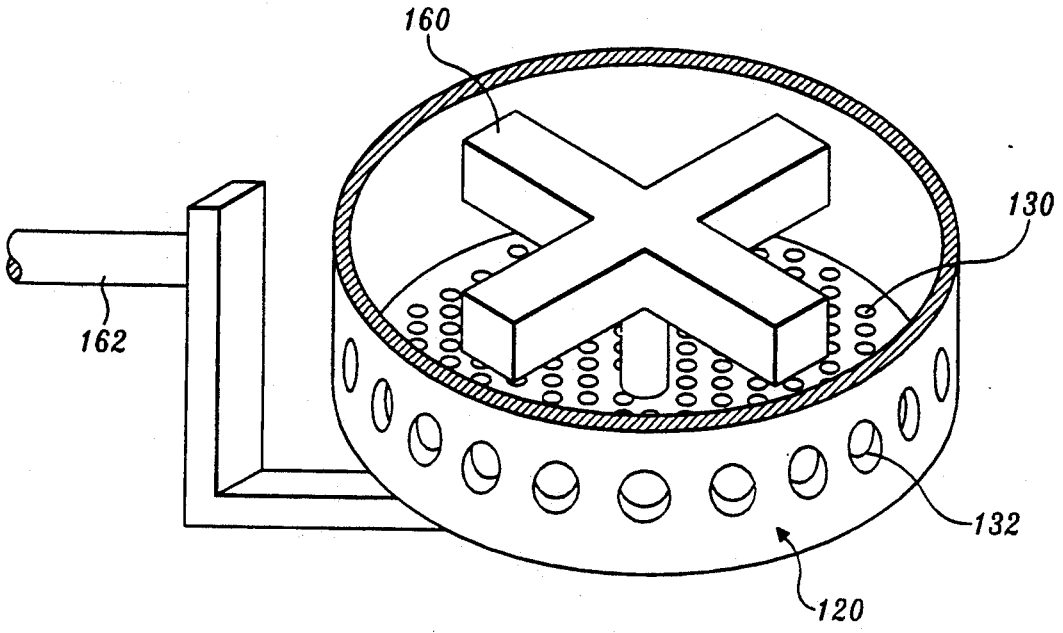
FIG. 5 is an enlarged partial cutaway view of the burn pot and shaker of the device illustrated in FIG. 1.

At the bottom of the burn pot is located a rotatable shaker 160 (FIGS. 1 and 5). The shaker 160 serves two purposes in the operation of the stove. First, the shaker 160 may be rotated through the use of a shaker rod 162. Pushing in or pulling out on the shaker rod 162 causes the shaker 160 to rotate within the burn pot 120. The rotation of the shaker 160 moves the ashes and unburned pellets located at the bottom of the burn pot. This movement causes the spent ash to fall through the apertures 132 and 130 located on the lower portion and bottom of the burn pot. These ashes then fall downwardly into the ash drawer 112 (FIG. 1). Use of the shaker 160 allows for easy cleaning of the burn pot when the stove is not in operation, and allows for the removal of excess ash located at the bottom of the burn pot when the stove is in operation.

The second function of the shaker 160 is to provide a heat sink that helps to maintain the temperature of the coals and burn pot. By maintaining the coals and the burn pot at an elevated temperature, the shaker 160 increases the efficiency of the stove consequently improving the cleanliness of the burn. In addition to the substantial heat sink provided, the shaker helps to bake the pellets and remove all of the air and moisture, thus helping the pellets to burn more efficiently. In the preferred embodiment, the shaker is formed of 0.25 inch by 1-inch stainless steel bars welded together to form a cross. Experimental test have shown that during operation the stainless steel shaker reaches a temperature of approximately 1,400° F.

Burn pot 120 includes a plurality of apertures 130 (FIG. 4) extending through bottom wall 122, and a second plurality of apertures 132 (FIG. 3) extending through sidewall 124. Preferably, apertures 130 are evenly spaced in a regular pattern in bottom wall 122, and apertures 132 are evenly spaced within parallel, evenly spaced rows in sidewall 124. The top row 133 of the apertures should be located as close to the top of the burn pot as possible in order to assist in producing a clean burn. As discussed in greater detail below, primary combustion air is introduced through apertures 130 and secondary combustion air is introduced through apertures 132.

Pellet level 134 represents the level of the top surface of the pellets positioned in burn pot 120 (a) when device 20 is connected with a chimney (not shown) having a draft sufficient to permit device 20 to operate at maximum combustion efficiency and to maintain emission levels below 0.04% and (b) when feed mechanism 60 is operated at its highest rate of feed. As used herein, the "highest rate of feed" or "maximum feed rate" means the fastest feed rate at which the natural draft of the chimney coupled with device 20 is capable of supporting combustion such that pellets are burned at substantially the same rate at which they are fed. This definition assumes that an unlimited quantity of combustion air is freely available to the burning pellets. Thus, for a chimney having a 3-inch diameter circular flue and a draft length of 12 feet, the combustion of pellets fed at perhaps 4 pounds per hour could be supported by the natural draft of such chimney. Similarly, for a chimney having a 6-inch diameter circular flue and a draft height of 15 feet, the combustion of pellets fed at perhaps 6 pounds per hour could be supported by the natural draft of such chimney. Thus, the maximum feed rate for a given device 20 will vary as a function of the natural draft of the chimney with which the device is coupled. In practice, under the conditions set forth in the first sentence of this paragraph, there is a slight cyclical variation of pellet level 134. The highest pellet level in the cycle remains below or even with bottommost ones of apertures 132 through which secondary combustion air is introduced into burn pot 120.

This cyclical variation in pellet level 134 is believed to be caused by naturally occurring changes in the burn rate of the pellets in pot 120. When pellet level 134 is at its highest level, a relatively large quantity of pellets is burning, with the result that a relatively large amount of heat is generated, thereby causing the draft in the chimney coupled with device 20 to increase. This increase in draft causes more air to be drawn into burn pot 120 through apertures 130 and 132, causing the fire to burn even hotter, with the result that the rate of combustion increases and the pellet level drops slightly. When the pellet level drops, the rate of combustion decreases because fewer pellets are available for burning, with the result that less heat is generated, thereby reducing the draft in the chimney coupled with device 20. Because feed mechanism 60 continues to supply pellets at a substantially constant rate, the pellet level soon rises again to the upper limit in the cycle. The rate of combustion then increases, thereby repeating the cycle discussed above. A complete cycle of this variation in pellet level occurs over a relatively short period of time, e.g., about 1 to 2 minutes, with the change in pellet depth being less than about 0.50 inch. As used herein, pellet level 134 means the average pellet level within the narrow range of variation in pellet level discussed above.

Figure 3:
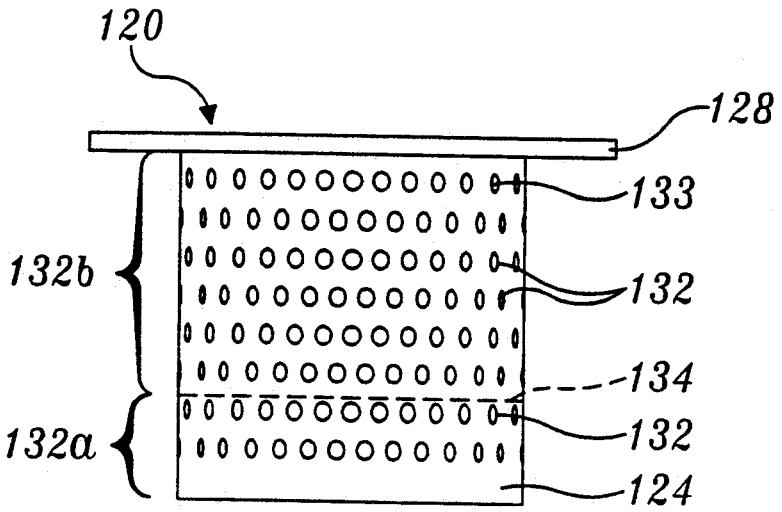
FIG. 3 is a side elevational view of one embodiment of the burn pot of the device illustrated in FIG. 1.
Figure 4:
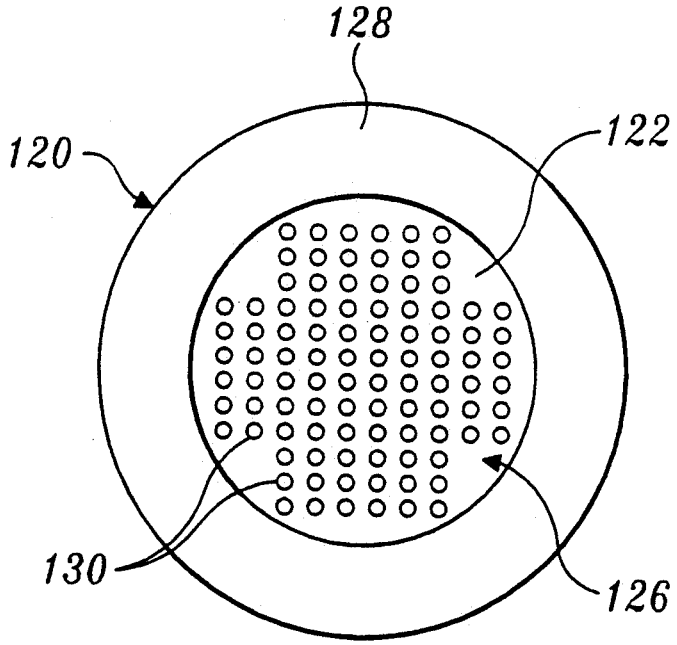
FIG. 4 is a top elevational view of the burn pot illustrated in FIG. 3.

Of course, when pellets are fed at less than the maximum feed rate, pellet level 134 will drop below the level illustrated in FIG. 3.

Specific flow rates of the draft required to optimize CO emissions and combustion efficiency will vary for a given draft as a function of the combined flow of air through the primary apertures 130, secondary apertures 132, and the opening 200. CO emissions and combustion efficiency are optimized when the primary apertures, secondary apertures and slot 200 together allow a specific flow rate of primary and secondary air. The dimensions of the apertures 130 and 132 and opening 200 may be obtained by trial and error for a given chimney, by varying aperture number and/or size until maximum combustion efficiency and minimum CO emission levels are obtained. One set of such dimensions is set forth below in connection with the description of the exemplary embodiment of the invention. However, combustion efficiency in the 90–98% range (based on a carbon-derived combustion efficiency formula) with CO levels in the 0.01–0.02% range is readily obtainable with the present invention.

Thus, burn pot 120 must be "tuned" for the chimney with which device 20 is to be coupled. As a corollary to this relationship, for a burn pot having primary and secondary apertures and an opening 200 which together provide a given flow of primary and secondary air, optimum CO levels and combustion efficiency may be obtained by varying the height of the chimney with which device 20 is coupled until combustion efficiency is maximized and CO emissions levels consistently remain below 0.04%.

Tests of device 20 indicate that (a) when feed mechanism 60 is operated at a maximum feed rate, (b) the total cross-sectional area of the apertures in burn pot 120 above the pellet level is about equal to the total cross-sectional area of the apertures in the burn pot below such pellet level, and (c) the draft of the chimney with which device 20 is coupled is such that maximum combustion efficiency is achieved and CO emissions levels consistently remain below 0.04%, then the volume of secondary combustion air entering interior 126 of burn pot 120 through the apertures positioned above the pellet level and through the opening 200, during a selected time interval, is about four times the volume of primary combustion air entering interior 126 through the apertures positioned below the pellet level during the same time interval. This four-to-one volume relationship may be used by those practicing the present invention in selecting the appropriate number and size of apertures in burn pot 120 and opening 200 for a given chimney, or the appropriate chimney height for a given burn pot. Tests additionally suggest that under the operating conditions set forth in the first sentence of this paragraph, the ratio of the flow of primary air to the flow of secondary air can be varied only a slight amount if optional combustion efficiency and CO levels below 0.04% are to be maintained. More specifically, it is believed that under the above-described operating conditions, optimal combustion efficiency and CO levels below 0.04% may be maintained when the volume of secondary air during any selected period of time is greater than 3.9 times the volume of primary air flowing through the apertures below the pellet level during the selected period of time.

However, it should be appreciated that when pellets are fed at the maximum feed rate the pellet level may temporarily rise above some of the bottom row of secondary combustion apertures 132, thereby causing the total volume of secondary air to drop below the level identified above. Because such rise in pellet level causes the rate of combustion of device 20 to rapidly increase, the pellets will drop back to pellet level 134 before CO emissions have a chance to rise above the 0.04% level. Thus, although under steady-state operating conditions the volume of flow of secondary air should remain between approximately 3.9 to 4.2 times the volume of flow of primary air, device 20 will accommodate temporary deviation from this ratio without increase in CO levels above 0.04%.

When feed mechanism 60 is operated at less than the maximum feed rate, thereby causing the pellet level to drop, the total cross-sectional area of the apertures in burn pot 120 above the new pellet level becomes greater than the total cross-sectional area of the apertures below the pellet level. Test results indicate that CO levels remain below 0.04% at such lower feed rates, although combustion efficiency typically drops below the level obtained when feed mechanism 60 is operated at the maximum feed rate. These test results were obtained when device 20 was coupled with a chimney having a draft such that maximum combustion efficiency and CO levels below 0.04% were obtained when feed mechanism 60 was operated at a maximum feed rate. In fact, CO levels below 0.04% may be maintained with device 60, even when the pellet level drops to a point where the total cross-sectional area of the apertures through which primary combustion air is provided is significantly greater than, e.g., 20 to 30 times greater than, the cross-sectional area of the apertures through which secondary combustion air is provided. Relatedly, at lower feed rates, the volume of primary air introduced through the apertures in burn pot 120 above the pellet level and through the opening 200 during a given time interval is about 20 to 30 times the volume of primary air introduced through the apertures below the pellet level, when CO levels below 0.04% are maintained.

Thus, the requirement that the ratio of the volume of secondary air to primary air remain within the range described above applies only when feed mechanism 60 is operated at a maximum feed rate and when device 20 is coupled with a chimney having a draft such that combustion efficiency of the device is optimized and CO levels remain below 0.04%. When device 20 is constructed to satisfy the low CO emissions/high combustion efficiency requirements at maximum feed rates.

From the preceding discussion it may be appreciated that burn pot 120 is tuned for the chimney with which it is designed to be coupled by operating feed mechanism 60 at a maximum feed rate and then adding apertures in equal number above and below the pellet level and to the opening 200 until combustion efficiency is maximized and CO levels are typically in the 0.01–0.02% range, and always below 0.04%. Thus, the total cross-sectional area of the apertures in burn pot 120 and opening 200 must be carefully selected to optimize the performance of device 20.

In operation, primary combustion air, identified at 150 in FIG. 1, enters interior 126 of burn pot 120 through apertures 130 in bottom wall 122 and through the apertures 132 in sidewall 124 positioned below pellet level 134. Secondary combustion air, identified at 152 and 210 in FIG. 1, enters interior 126 through those apertures 132 positioned above pellet level 134 and through the opening 200. Both primary and secondary combustion air travels solely by natural convection. All the primary and some of the secondary air enters through opening 114 in pedestal 110 and into and through apertures 130 and 132. Primary combustion air is used in the initial combustion of the pellets in burn pot 120. This initial combustion results in gasification of the wood and some combustion of the gases thus produced. Additional combustion of such wood gases is supported by the secondary combustion air. Because the combustion air and wood gases flow up through aperture 28 in floor 27, through combustion chamber 24, and out aperture 26 in ceiling 25, combustion of the gases driven off from the wood generally appears as a column of fire 154 (FIG. 1) extending upwardly from burn pot 120.

As discussed above, at lower feed rates combustion efficiency may decrease but the CO levels remain below 0.04%. Combustion efficiency may be increased at lower feed rates by using flow adjustment (not shown) to adjust the flow of the primary and/or secondary air in order to maintain proper flow rates for maximum efficiency at lower feed rates.

Exemplary Embodiment

As those of ordinary skill in the art will appreciate, the specific size, number, and placement of apertures 130 and 132 and opening 200, as well as the shape and configuration of burn pot 120, will vary as a function of the desired heat output of device 20, the draft of the chimney with which device 20 is coupled, and the feed rate of feed mechanism 60. However, in one embodiment of the present invention, (a) in which heating device 20 consists of a stove designed to provide a maximum heat output of about 38,000 BTUs per hour, (b) the stove is designed to be coupled with a chimney having (i) a draft height of 12 feet (as measured from the surface on which the stove is positioned) and (ii) a flue with a circular cross section about 6 inches in diameter, and (c) includes a feed mechanism 60 having a maximum feed rate of about 6 pounds of APFI pellets per hour, burn pot 120 has a cylindrical configuration, and its interior 126 is about 3.5 inches deep and 3.0 inches in diameter.

Apertures 130 consist of 86 circular openings in bottom wall 122, each having a diameter of 0.125 inch, with the holes being evenly spaced within a cross pattern comprising two legs which extend in right angle relation, each across substantially an entire diameter of bottom wall 122. Apertures 132 consist of 176 circular holes, each having a diameter of about 0.125 inch. Preferably, the holes are arranged in 8 horizontal rows of 22 holes each, with the holes being evenly spaced within the rows, and the rows being evenly spaced so as to extend over substantially the entire vertical length of sidewall 124. The rows of holes are additionally spaced so that two rows are positioned below pellet level 134 and 6 rows are positioned above pellet level 134.

As a consequence of this placement of apertures 130 and 132, one hundred and thirty (130) apertures are provided in bottom wall 120 and the portion of sidewall 124 positioned below pellet level 134, and one hundred and thirty-two (132) apertures are positioned above pellet level 134. Thus, the total cross-sectional area of the apertures positioned below pellet level 134 is substantially equal to the total cross-sectional area of the apertures positioned above pellet level 134 when the stove is tuned to operate at peak combustion efficiency.

Opening 200 comprises five 0.5 inch holes. It has been determined that with respect to the embodiment of device 20 described above, the volume of secondary air introduced into stove 20 during a given time interval is about four times the volume of primary air which is introduced into stove 20.

Exhaust gases emitted by the stove 20 described in the preceding paragraph, when the stove was coupled with a chimney having a 12-foot draft height and a circular flue with a diameter of 6 inches, and when feed mechanism 60 was operated so as to feed about 6 pounds of APFI pellets per hour into burn pot 120, had a carbon monoxide content, by volume, of about 0.00–0.02%, with the carbon monoxide content never going above 0.04%. In addition, the carbon dioxide content, by volume, of the exhaust gases emitted from the stove averaged about 10%, and ranged between 6% and 12%. Also, the combustion efficiency of stove 20, when operated so that its CO output is in the 0.00–0.02% range was about 85–95%. Furthermore, the overall efficiency of stove 20 was about 70%, with higher overall efficiency being achieved at intermediate feed rates, e.g., 2–5 pounds of APFI pellets per hour. This high combustion level and low emissions output was achieved without the use of a fan system for urging combustion air into burn pot 120 or for extracting exhaust gases from stove 20.

The ability to achieve such a high rate of combustion and low rate of emissions without a fan system for introducing combustion air into or extracting exhaust gases from heating device 20 is highly advantageous from both an environmental and a cost standpoint. A pellet burning stove built and operated in accordance with the teachings of the present invention will burn sufficiently cleanly to satisfy all current federal and state air pollution laws. As to cost, by avoiding the need for a separate fan system for adding air to or withdrawing gases from stove 20, the latter may be sold at the retail level for about $200–$300 less than pellet burning stoves incorporating fan systems for introducing combustion air or extracting exhaust gases.

Figure 6:
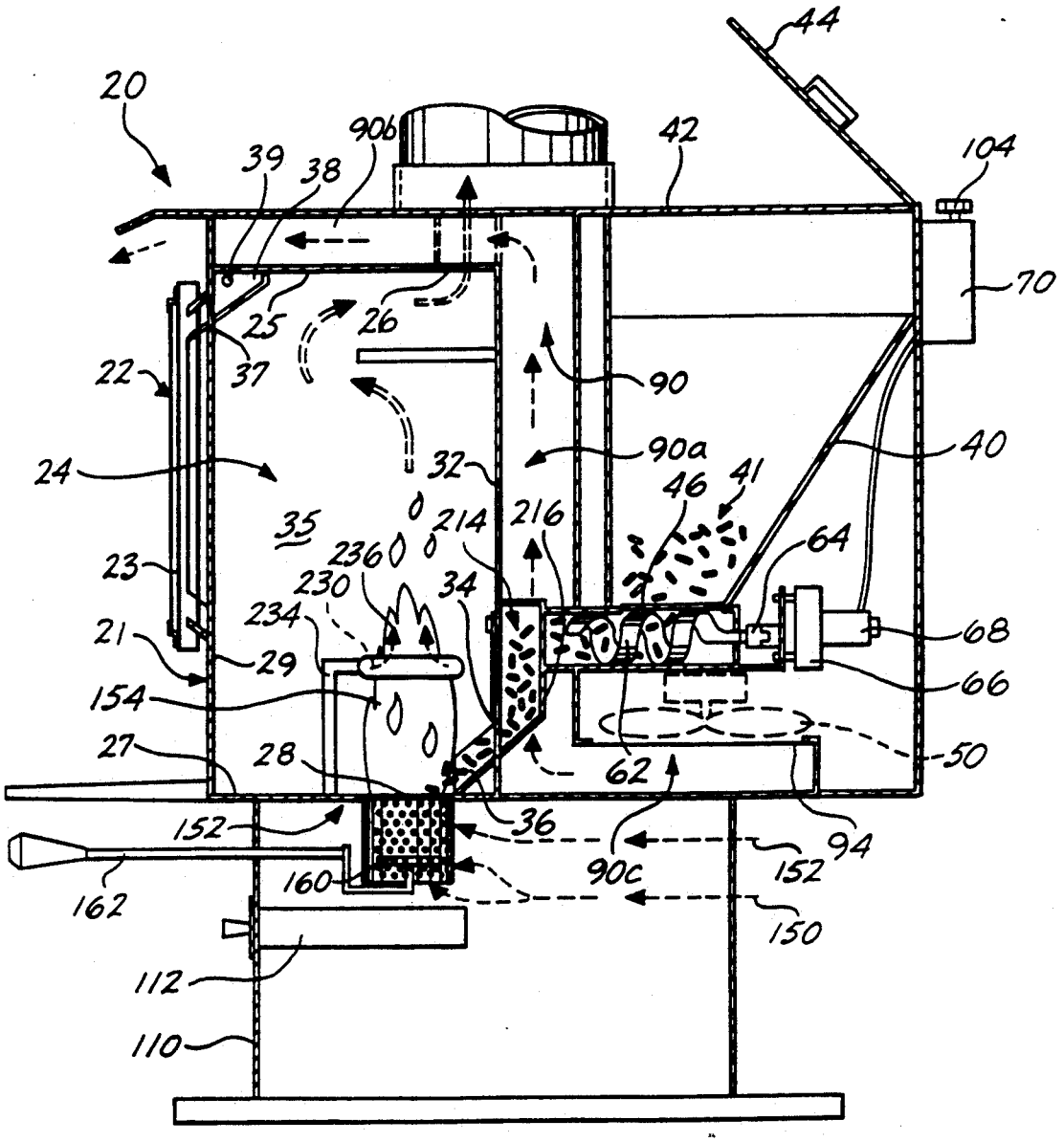
FIG. 6 is a cross section, side elevational view of a second embodiment of a heating device of the present invention.
Figure 7:
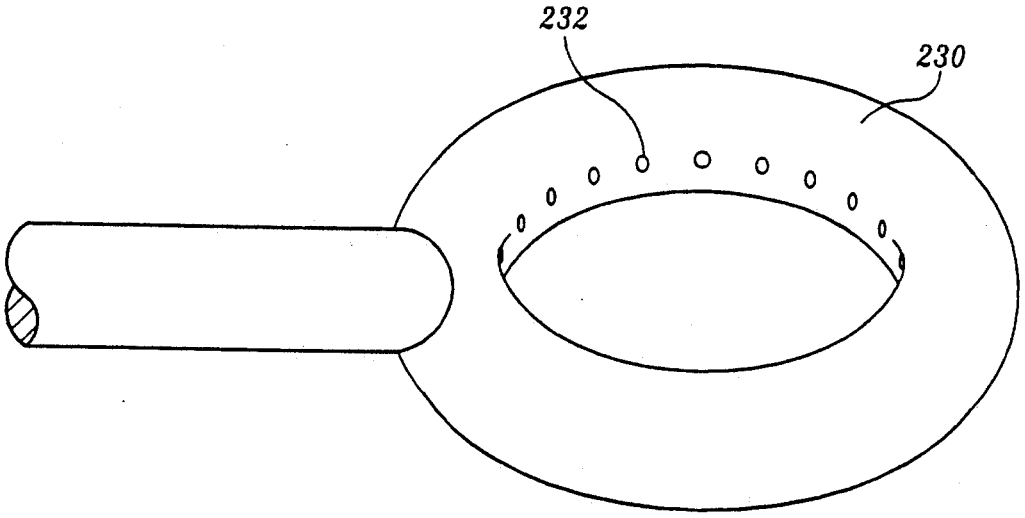
FIG. 7 is a perspective view of the air supply device of the second embodiment of the present invention.

Now referring to FIGS. 6 and 7, a second embodiment of the present invention is illustrated. The parts of the second embodiment that are the same as the first embodiment are identified by the same reference numbers and are fully described with respect to the description of the first embodiment. The second embodiment differs from the first embodiment only in the manner of introducing secondary air into the stove 20.

In the second embodiment, there is no opening 200 (FIG. 1) in the front wall 29 of the housing. Instead, two apertures are provided in the sidewalls of housing 21, the one in sidewall 35 being identified at 39. Apertures 39 are positioned so as to intersect passageway 38, whereby outside air may pass into the passageway. Apertures 39 are provided to supply a wash of cool air to window 23 and door 22. More specifically, during operation of device 20, relatively cool air passes through apertures 39 into passageway 38, travel along the passageway and spill out along the outermost part of plate 37 onto the inner surface window 23. This cool air wash prevents carbon deposits from building up on the inner surface of window 23, thereby permitting the viewing of the fire within combustion chamber 24. The apertures 39 are relatively small. In the preferred embodiment, each aperture has a diameter of approximately 0.25 inch. The apertures must be of sufficient size to allow the quantity of air delivered by a passageway 38 to prevent excessive carbon deposits on the inner surface of window 23.

The second embodiment shown in FIG. 6 also includes an air supply 230. In the second embodiment, the air supply 230 is a cylindrical piece of tubing formed into a toroidal shape. A number of apertures 232 are located on the inner surface of the air supply 230. Secondary air 152 is introduced into the air supply 230 through tubing 234 connected to the bottom of housing 21 such that secondary air 152 may flow through the opening 114 (FIG. 2) the bottom of the housing and the support tubing 234 into the air supply 230. Air supply 230 is positioned such that it is located above the floor 27 of the housing and centered around an upper portion of the column of fire 154. Secondary air flows through the apertures 232 and helps feed the column of fire 154, as shown by arrows 236.

As described with respect to the first embodiment, it is important to size the cross-sectional area of the apertures 232 and 39 such that the total volume of secondary air entering the stove 35 is approximately four times the total volume of primary air entering through the apertures 130 and 132 in the floor and lower portion of the burn pot 120 respectively. As described in more detail with respect to the first embodiment, the cross section area of the apertures should be adjusted when the feed mechanism 60 is operated at a maximum feed rate. Proper determination of the total cross-sectional area of the apertures 232, 239, 130, and 132 achieves maximum combustion efficiency with CO mission levels consistently remaining below 0.04%. In the second embodiment, the air supply 230 has an inside diameter of 3.0 inches, and includes 22 apertures each with a diameter of 0.125 inches. The air supply 230 is located approximately 4.0 inches from the floor 27 of the housing. It should be noted that other dimensions, shapes, and locations for the air supply 230 may be used depending upon the dimensions of the stove, the length of the chimney, etc.

Since certain changes may be made in the above device without departing from the scope of the invention here involved, it is intended that all matter contained in the above description or shown in the accompanying drawings shall be interpreted in an illustrative and not in a limiting sense.

The embodiments of the invention in which an exclusive property or privilege is claimed are defined as follows:

1. A pellet burning heating device designed to be coupled with a chimney, the device comprising:

a housing having a combustion chamber, said housing having a first aperture through which exhaust gases may escape from said combustion chamber, said first aperture being coupleable with the chimney;

a burn pot having an interior for supporting a plurality of pellets during combustion thereof, said burn pot being attached to said housing so that said interior is in communication with said combustion chamber via a second aperture;

feed means for dispensing pellets into said interior of said burn pot; and combustion air intake means for coupling said combustion chamber with an atmosphere surrounding said housing so as to permit combustion air to flow into said combustion chamber solely by natural convection so as to supply air so as to permit pellets positioned in said interior to burn in a manner such that exhaust gases generated by such burning and withdrawn from said combustion chamber have a CO content of 0.04% or less, said combustion air intake means including a third aperture in said burn pot so as to permit combustion airflow into said burn pot and a fourth aperture in said housing so as to permit airflow into said combustion chamber.

2. A device according to claim 1, wherein said combustion air intake means further comprises air supply means for providing airflow to a portion of the combustion flame above the burn pot, said fourth aperture being coupled to said air supply so as to permit airflow through said housing to said air supply.

3. A device according to claim 2, wherein said air supply includes a toroidal member including a plurality of apertures located on an inner surface so as to provide airflow to said portion of said combustion flame above the burn pot.

4. A device according to claim 1, wherein said housing further comprises:

a window mounted in said combustion chamber so as to permit viewing of said combustion chamber; and wherein the fourth aperture provides a wash of relatively cool airflow from said atmosphere into said combustion chamber so as to flow over an inner surface of said window so as to reduce the tendency of carbon deposits to build up on said inner surface.

5. A device according to claim 1, further comprising shaker means located in said burn pot for agitating the pellets and ash located in the burn pot.

6. A device according to claim 5, wherein the shaker means includes heat sink means for providing a heat sink so as to increase combustion efficiency.

7. A device according to claim 1, wherein said feed means is designed to feed pellets into said interior at a rate selected such that pellets burning in said burn pot are maintained approximately at a predetermined level, further wherein said burn pot comprises a bottom wall and a sidewall, and wherein said combustion air intake means comprises a plurality of apertures extending through said bottom wall and extending through a portion of said sidewall.

8. A device according to claim 1, wherein the pellet feed assembly further comprises a drop chute positioned so as to allow pellets to fall downwardly out of said feed means into said interior of said burn pot so as to prevent back burn.

9. A device according to claim 8, wherein said housing includes a floor, said second aperture extending through said floor, said burn pot being attached to said housing so as to be positioned below said floor, further wherein said feed means and drop chute is positioned so as dispense pellets through said second aperture in said floor and into said interior of said burn pot.

10. A device according to claim 1, wherein a ratio of an amount of secondary air entering said combustion chamber through said third and fourth apertures is greater than approximately 3.9 times an amount of primary air entering said combustion chamber through said third aperture.

11. A pellet burning stove designed to be coupled with a chimney, the stove comprising:

a combustion chamber having first and second inlets through which combustion air may be introduced into said chamber and an outlet through which exhaust gases may be removed from said combustion chamber;

a burn pot having an interior for supporting a quantity of pellets during the combustion thereof, said burn pot comprising a plurality of apertures through which primary and secondary combustion air may be introduced into said interior, said burn pot being coupled with said combustion chamber via said first inlet in said combustion chamber so that said primary combustion air may be introduced into said interior through said plurality of apertures and pass through said inlet into said combustion chamber;

a pellet feed assembly for feeding pellets into said interior of said burn pot so that said quantity of pellets supported in said interior may be maintained at approximately a constant level; and wherein said second inlet provides secondary airflow to a portion of the combustion flame located above the burn pot and wherein the number and cross-sectional area of said plurality of apertures and said second inlet are selected so that exhaust gases generated as a consequence of the combustion of said quantity of pellets in said interior of said burn pot are withdrawn solely by the draft of the chimney coupled with said combustion chamber, and have a concentration of carbon monoxide, by volume, of no more than 0.04% when said quantity of pellets is maintained at approximately a predetermined pellet level.

12. A device according to claim 11, wherein said primary and secondary air are introduced into said combustion chamber solely by natural convection.

13. A device according to claim 11, further comprising air supply for providing airflow to a portion of said combustion flame above the burn pot, wherein said second inlet provides secondary airflow through said air supply.

14. A device according to claim 13, wherein said air supply means includes a toroidal member including a plurality of apertures located on an inner surface so as to provide airflow to said portion of the combustion flame above the burn pot.

15. A device according to claim 11, wherein said housing further comprises a window mounted in said combustion chamber so as to permit viewing of said combustion chamber and wherein the second inlet provides a wash of relatively cool airflow into said combustion chamber so as to flow over an inner surface of said window so as to reduce the tendency of carbon deposits to build up on said inner surface.

16. A device according to claim 11, further comprising shaker means located in said burn pot for agitating said quantity of said pellets and ash located in the burn pot.

17. A device according to claim 16, wherein the shaker means includes heat sink means for providing a heat sink so as to increase combustion efficiency.

18. A device according to claim 11, wherein the pellet feed assembly further comprises a drop chute positioned so as to allow pellets to fall downwardly out of said feed means into said interior, said burn pot as to prevent back burn.

19. A pellet burning heating device designed to be coupled with a chimney, the device comprising:

a housing having a combustion chamber, said housing having a first aperture through which exhaust gases may escape from said combustion chamber, said first aperture being coupleable with the chimney;

a burn pot having an interior for supporting a plurality of pellets during combustion thereof, said burn pot being attached to said housing so that said interior is in communication with said combustion chamber via a second aperture;

feed means for dispensing pellets into said interior of said burn pot; and combustion air intake means for coupling said combustion chamber with an atmosphere surrounding said housing so as to permit combustion air to flow into said combustion chamber solely by natural convection so as to supply air so as to permit pellets positioned in said interior to burn in a manner such that exhaust gases generated by such burning and withdrawn from said combustion chamber have a CO content of 0.04% or less, said combustion air intake means including a third aperture in said burn pot so as to permit combustion airflow into said burn pot and a fourth aperture in said housing so as to permit airflow into said combustion chamber, and air supply means for providing airflow to a portion of the combustion flame above the burn pot, said fourth aperture being coupled to said air supply means so as to permit airflow through said housing to said air supply.

20. A pellet burning heating device designed to be coupled with a chimney, the device comprising:

a housing having a combustion chamber, said housing having a first aperture through which exhaust gases may escape from said combustion chamber, said first aperture being coupleable with the chimney and a window mounted in said combustion chamber so as to permit viewing of said combustion chamber;

a burn pot having an interior for supporting a plurality of pellets during combustion thereof, said burn pot being attached to said housing so that said interior is in communication with said combustion chamber via a second aperture;

feed means for dispensing pellets into said interior of said burn pot; and combustion air intake means for coupling said combustion chamber with an atmosphere surrounding said housing so as to permit combustion air to flow into said combustion chamber solely by natural convection so as to supply air so as to permit pellets positioned in said interior to burn in a manner such that exhaust gases generated by such burning and withdrawn from said combustion chamber have a CO content of 0.04% or less, said combustion air intake means including a third aperture in said burn pot so as to permit combustion airflow into said burn pot and a fourth aperture in said housing to provide a wash of relatively cool airflow from said atmosphere into said combustion chamber so as flow over an inner surface of said window so as to reduce the tendency of carbon deposits to build up on said inner surface.

* * * * *

UNITED STATES PATENT AND TRADEMARK OFFICE

CERTIFICATE OF CORRECTION

PATENT NO. : 5,285,738

DATED : February 15, 1994

INVENTOR(S) : L. D. Cullen

It is certified that error appears in the above-indentified patent and that said Letters Patent is hereby corrected as shown below:

| COLUMN | LINE | |
|---|---|---|
| 5 | 39 & 40 | "rata-tional" should read --rotational-- |
| 6 | 32 | "convention" should read --convection-- |
| 6 | 63 | "matiral" should read --natural-- |
| 7 | 61 | "test" should read --tests-- |
| 13 | 7 | after "fire 154." delete "Secondary" and insert --The secondary-- |

Signed and Sealed this

Fifth Day of July, 1994

Bruce Lehman

*Attest:*

BRUCE LEHMAN

*Attesting Officer*

*Commissioner of Patents and Trademarks*